US008235746B2

(12) United States Patent
He

(10) Patent No.: US 8,235,746 B2
(45) Date of Patent: Aug. 7, 2012

(54) USB CONNECTOR STRUCTURE

(75) Inventor: Jin-Min He, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 61 days.

(21) Appl. No.: 12/905,209

(22) Filed: Oct. 15, 2010

(65) Prior Publication Data

US 2012/0003854 A1 Jan. 5, 2012

(30) Foreign Application Priority Data

Jun. 30, 2010 (CN) ..... 2010 2 0243155 U

(51) Int. Cl.
*H01R 11/00* (2006.01)

(52) U.S. Cl. ..... 439/502; 439/638

(58) Field of Classification Search ..... 439/502, 439/638–640

See application file for complete search history.

(56) References Cited

U.S. PATENT DOCUMENTS

| | | | | |
|---|---|---|---|---|
| 6,283,789 | B1 * | 9/2001 | Tsai | 439/502 |
| 6,746,273 | B1 * | 6/2004 | Liu et al. | 439/502 |
| 6,786,764 | B2 * | 9/2004 | Sivertsen | 439/502 |
| 7,465,187 | B1 * | 12/2008 | Wu | 439/502 |
| 7,591,673 | B2 * | 9/2009 | Chan et al. | 439/502 |

* cited by examiner

*Primary Examiner* — Truc Nguyen

(74) *Attorney, Agent, or Firm* — Altis Law Group, Inc.

(57) ABSTRACT

A USB connector structure for connecting an electronic device to a computer includes a cable, a first plug group and a second plug group. The first plug group and the second plug group are connected to opposite ends of the cable. The first plug group includes a first standard USB plug and a first mini USB plug electrically connected to the first standard USB plug. The second plug group is connected to another end of the cable, and includes a second standard USB plug and a second mini USB plug electrically connected to the second standard USB plug. Any two of the first standard USB plugs, the first mini USB plug, the second standard USB plug and the second mini USB plug can be respectively electrically connected with the electronic device and the computer.

19 Claims, 2 Drawing Sheets

USB CONNECTOR STRUCTURE

BACKGROUND

1. Technical Field

The disclosure generally relates to connectors, and more particularly relates to, a USB (universal serial bus) connector structure.

2. Description of the Related Art

USB connectors are widely used to connect the electronic devices, such as mobile phones, MP3 players, and digital cameras, to computers to transmit data and power. Typically, the USB connector includes two kinds of connectors: standard USB connector and mini USB connector. Such two kinds of connectors correspond to a standard USB plug and a mini USB plug. There are three kinds of USB connector structures combinations: a pair of standard USB plugs, a pair of mini USB plugs, and a standard USB plug and a mini USB plug connected by a cable.

However, in practical use, different electronic devices provide different USB plugs, any of the USB connector structures may not meet all the requirements to connect any electronic device to the computer. The present USB connector structures lack versatility and universality.

Therefore, there is room for improvement within the art.

BRIEF DESCRIPTION OF THE DRAWINGS

Many aspects of an exemplary USB connector structure can be better understood with reference to the following drawings. The components in the drawings are not necessarily drawn to scale, the emphasis instead being placed upon clearly illustrating the principles of the exemplary USB connector structure. Moreover, in the drawings, like reference numerals designate corresponding parts throughout the several views. Wherever possible, the same reference numbers are used throughout the drawings to refer to the same or like elements of an embodiment.

DETAILED DESCRIPTION

Figure 1:
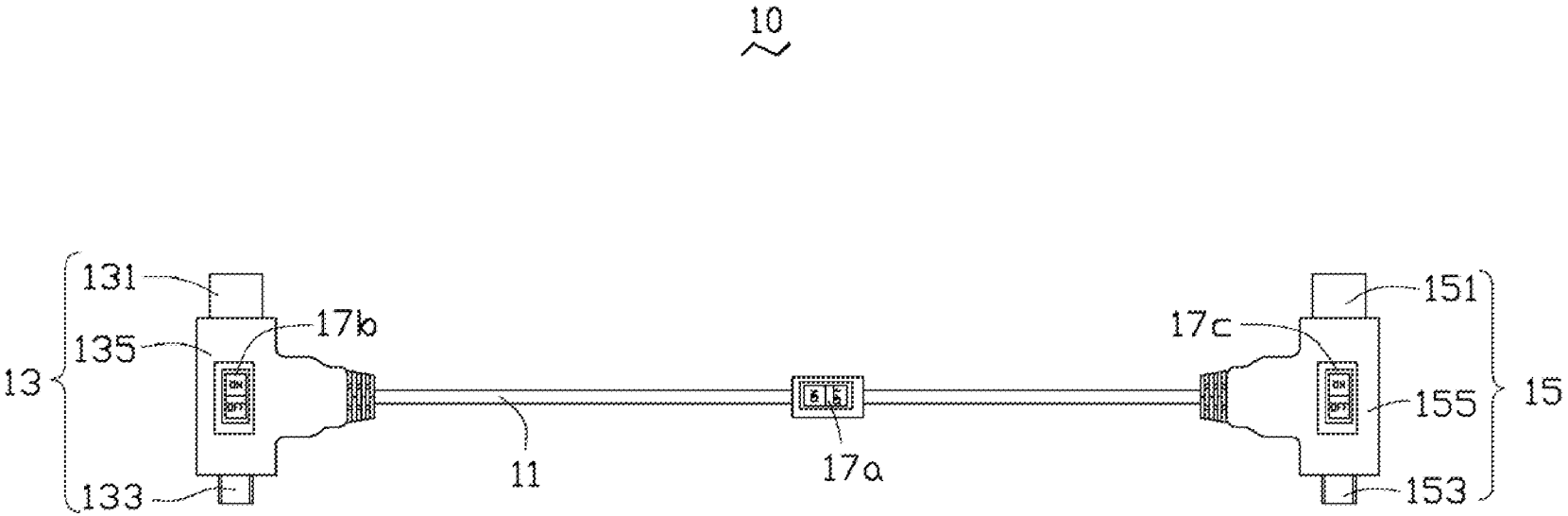
FIG. 1 is a schematic structure view of a USB connector structure, according to an exemplary embodiment.

FIG. 1 shows a USB (universal serial bus) connector structure 10 for connecting an electronic device, such as mobile phone or digital camera, to a computer to exchange data or charge the electronic device. The USB connector structure 10 includes a cable 11, a first plug group 13 and a second plug group 15. The first plug group 13 and the second plug group 15 are connected to opposite ends of the cable 11.

The first plug group 13 includes a first standard USB plug 131 and a first mini USB plug 133 and a first housing 135, and the first standard USB plug 131 and the first mini USB plug 133 are partially received within the first housing 135. The second plug group 15 includes a second standard USB plug 151, a second mini USB plug 153 and a second housing 155, the second standard USB plug 151 and the second mini USB plug 153 are partially received within the second housing 155. In this exemplary embodiment, the standard USB plugs 131 and 151 can be standard-A type of USB plugs to carry both power and data or be standard-B type of USB plugs which typically plug into an upstream receptacle on an electronic device, e.g. a printer to carry data and/or power.

Figure 2:
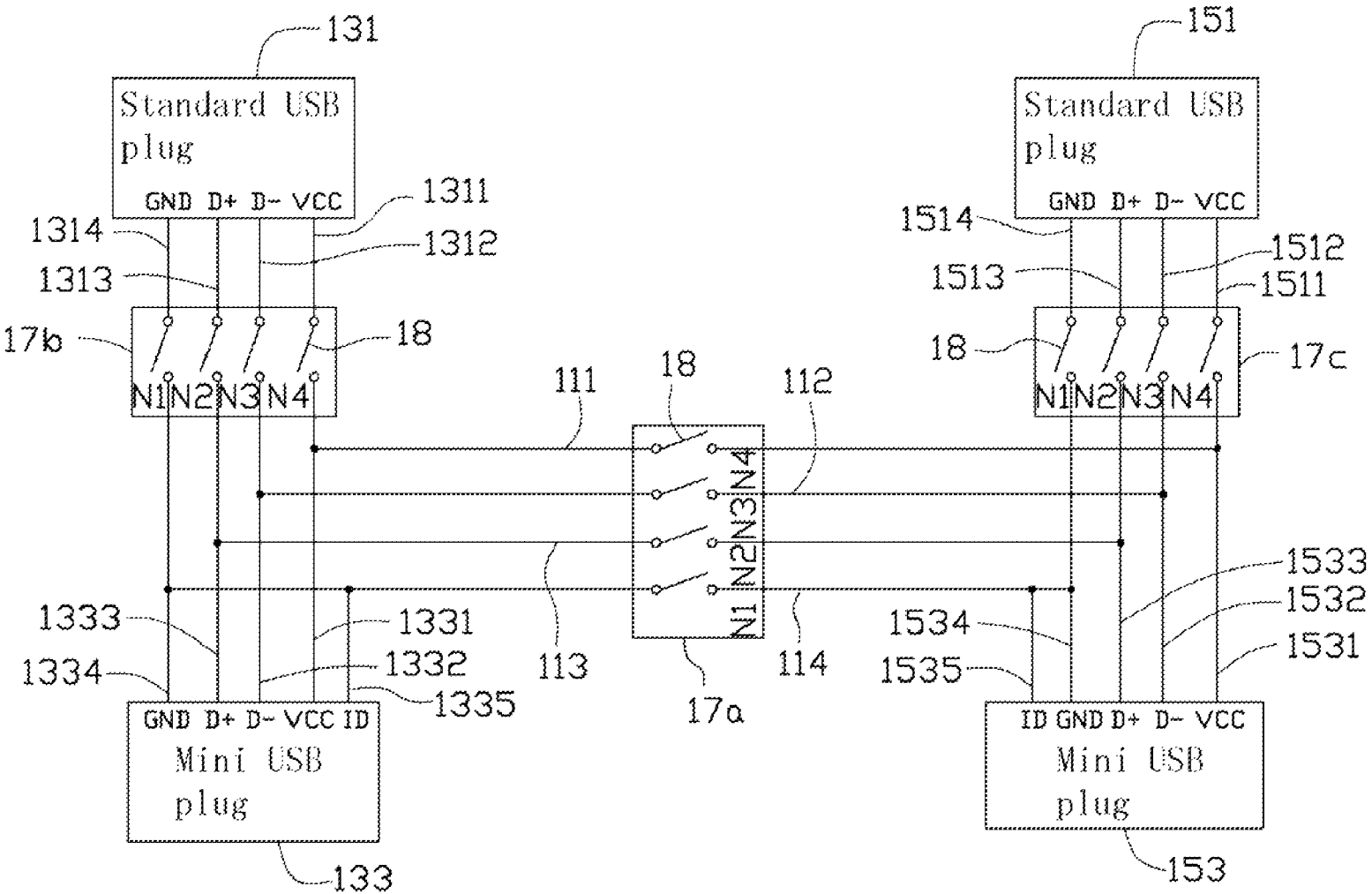
FIG. 2 is a circuit view of the USB connector structure as shown in FIG. 1.

Referring to FIG. 2, the cable 11 uses a twisted pair to reduce noise and crosstalk and includes a power line 111, a first data line 112, a second data line 113 and a ground line 114. The first data line 112 and the second data line 113 transmit and receive data or power between different electronic devices or between the electronic device and the computer.

The first standard USB plug 131 includes a power pin (VCC) 1311, a pair of data pins (D−) 1312 and (D+) 1313, and a ground pin (GND) 1314. The first mini USB plug 133 includes a power pin (VCC) 1331, a pair of data pins (D−) 1332 and (D+) 1333, a ground pin (GND) 1334 and an identification (ID) pin 1335. The power pin 1311, the data pins 1312 and 1313, and the ground pin 1314 are respectively electrically connected to the power pin 1331, the data pins 1332 and 1333, and the ground pin 1334. The second standard plug 151 includes a power pin 1511, a pair of data pins 1512 and 1513, and a ground pin 1514. The second mini USB plug 153 includes a power pin 1531, a pair of data pins 1532 and 1533, a ground pin 1534, and an ID pin 1535. The power pin 1511, the data pins 1512 and 1513, and the ground pin 1514 are respectively electrically connected to the power pin 1531, the data pins 1532 and 1533, and the ground pin 1534.

The power pins 1311, 1331, 1511 and 1531 are electrically connected to the power line 111 of the cable 11. The data pins 1312, 1332, 1512 and 1532 are electrically connected to the first data line 112. The data pins 1313, 1333, 1513 and 1533 are electrically connected to the second data line 113. The group pins 1314, 1334, 1514 and 1534 are electrically connected to the group line 114, and the ID pins 1335 and 1535 are floating or are electrically connected to the ground line 114. In this exemplary embodiment, the ID pins 1335 and 1535 are electrically connected to the ground line 114. Thus, any two of the first standard USB plug 131, the first mini USB plug 133, the second standard USB plug 151 and the second mini USB plug 153 can transmit data between each other.

Also referring to FIG. 1, the USB connector structure 10 further includes at least one switch module, and each switch module includes a plurality of switches 18. In this exemplary embodiment, the number of the switch modules is three. One switch module 17*a* is located on the cable 11, one switch module 17*b* is located on the first plug group 13, and is electrically connected between the first standard USB plug 131 and the first mini USB plug 133, and is exposed from the first housing 135 to operate. The other switch module 17*c* located on the second plug group 15 is electrically connected between the second standard USB plug 151 and the second mini USB plug 153, and is exposed from the second housing 155 to operate. Each switch module includes four switches 18, which are respectively electrically connected to the power line 111, the two data lines 112 and 113, and the ground line 114. Switching the state of switch module simultaneously changes the states of all the switches 18 of that switch module.

In use, when the USB connector structure 10 is used to connect an electronic device to a computer, and any two USB plugs are inserted into the electronic device and the computer for transmitting data or power. For example, the USB connector structure 10 may be used to connect a MP3 to a computer for charging the MP3. In this example, the first standard USB plug 131 and the second mini USB plug 153 are respectively electrically connected between the computer and the MP3. The switch module 17*a* and the switch module 17*b* are switched from an off state to an on state. Therefore, the switches 18 within the switch modules 17*a* and 17*b* are switched on to electrically respectively connect the contacts N1, N2, N3 and N4.

Similarly, when the switch module 17*a* is switched on, the second standard USB plug 133 and the second mini USB plug 153 can be used. When the switch module 17*a* and the switch module 17*b* are switched on, the plug combinations: the first standard USB plug 131 and the second mini USB plug 153, and the second standard USB plug 133 and the second mini USB plug 153, can be used. When the switch module 17*a* and the switch module 17*c* are switched on, the plug combinations: the second standard USB plug 151 and the second mini USB plug 153, and the second standard USB plug 133 and the second mini USB plug 153, can be used. When the switch modules 17*a*, 17*b* and 17*c* are switched on, any two of the first standard USB plug 131 and the first mini USB plug 133, the second standard USB plug 151 and the second mini USB plug 153 can be used to transmit data or power.

When the data transmission or charge is complete, the USB plugs can be unplugged from the electronic device, such as MP3, mobile phone. However, there is no need to unplug or remove the USB plugs from the computer, thereby substantially preventing wear and tear on the USB plugs from repeated plugging and unplugging. By switching the switch modules 17*a*, 17*b* and 17*c* from their on state to their off state, the USB connector structure 10 itself is prevented from power consumption.

The USB connector structure 10 of the exemplary embodiment, any two of the first standard USB plug 131, the first mini USB plug 133, the second standard USB plug 151 and the second mini USB plug 153 are electrically connected to each other by the cable 11 to transmit and exchange data and power. Thus, the USB connector structure 10 can be used in different electronic devices to transmit data or power, so the USB connector structure 10 has better versatility and universality.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in matters of shape, size, and arrangement of parts within the principles of exemplary disclosure to the full extent indicated by the broad general meaning of the terms in which the appended claims are expressed.

What is claimed is:

1. A USB connector structure for connecting an electronic device to a computer, comprising:

a cable for transmitting data or power;

a first plug group connected to an end of the cable, the first plug group comprising a first standard USB plug and a first mini USB plug electrically connected to the first standard USB plug;

a second plug group connected to another end of the cable, the second plug group comprising a second standard USB plug and a second mini USB plug electrically connected to the second standard USB plug; and a plurality of switch modules, wherein one switch module is located on the cable between the plug groups, another switch module is located on the first plug group and electrically connected between the first standard USB plug and the first mini USB plug, another switch module is located on the second plug group and electrically connected between the second standard USB plug and the second mini USB plug, any two of the first standard USB plug, the first mini USB plug, the second standard USB plug and the second mini USB plug can be electrically and selectively connected with the electronic device and the computer, respectively.

2. The USB connector structure as claimed in claim 1, wherein the first standard USB plug and the second standard USB plug are standard-A type of USB plugs to carry both power and data.

3. The USB connector structure as claimed in claim 1, wherein the first standard USB plug and the second standard USB plug are standard-B type of USB plugs to carry power and/or data.

4. The USB connector structure as claimed in claim 1, wherein the cable uses a twisted pair to reduce noise and crosstalk and comprises a power line, a first data line and a second data line and a ground line, and the first data line and the second data line are capable of transmitting and receiving data or power.

5. The USB connector structure as claimed in claim 1, wherein the first standard USB plug comprises a power pin, a pair of data pins, and a ground pin, the first mini USB plug comprises a power pin, a pair of data pins, a ground pin and an identification pin, and the power pin, the data pins and the ground pin of the first standard USB plug are electrically connected to the power pin, the data pins and the ground pin of the first mini USB plug, respectively.

6. The USB connector structure as claimed in claim 5, wherein the second standard plug comprises a power pin, a pair of data pins and a ground pin, the second mini USB plug comprises a power pin, a pair of data pins, a ground pin and an identification pin, and the power pin, the data pins and the ground pin of the second standard USB plug are electrically connected to the power pin, the data pins and the ground pin of the second mini USB plug, respectively.

7. The USB connector structure as claimed in claim 6, wherein the power pins are electrically connected to the power line of the cable, the data pins are electrically connected to the first data line, the data pins are electrically connected to the second data line, the group pins are electrically connected to the group line, and the identification pins are floating or are electrically connected to the ground line.

8. The USB connector structure as claimed in claim 1, wherein the first plug group further comprises a first housing, the second plug group further comprises a second housing, and the first standard USB plug and the first mini USB plug are at least partially received within the first housing, the second standard USB plug and the second mini USB plug are at least partially received within the second housing.

9. The USB connector structure as claimed in claim 8, wherein the switch modules are exposed from the first housing and the second housing, and each switch module comprises four switches, and the switches are electrically connected to the power line, the two data lines, and the ground line, respectively.

10. A USB connector structure for connecting an electronic device to a computer, comprising:

a cable for transmitting data or power;

a first plug group connected to an end of the cable, the first plug group comprising a first standard USB plug and a first mini USB plug electrically connected to the first standard USB plug;

a second plug group connected to another end of the cable, the second plug group comprising a second standard USB plug and a second mini USB plug electrically connected to the second standard USB plug; and a plurality of switch modules, the switch modules respectively located on the cable, the first plug group and the second plug group, wherein depending on the on/off status of each switch module, at least two of the first standard USB plug, the first mini USB plug, the second standard USB plug and the second mini USB plug can be electrically connected, and can be respectively electrically connected to the electronic device and the computer via the switch modules.

11. The USB connector structure as claimed in claim 10, wherein the first standard USB plug and the second standard USB plug are standard-A type of USB plugs to carry both power and data.

12. The USB connector structure as claimed in claim 10, wherein the first standard USB plug and the second standard USB plug are standard-B type of USB plugs to carry power and/or data.

13. The USB connector structure as claimed in claim 10, wherein the cable uses a twisted pair to reduce noise and crosstalk and comprises a power line, a first data line and a second data line and a ground line, and the first data line and the second data line are capable of transmitting and receiving data or power between different electronic devices or between the electronic device and the computer.

14. The USB connector structure as claimed in claim 10, wherein the first standard USB plug comprises a power pin, a pair of data pins, and a ground pin, the first mini USB plug comprises a power pin, a pair of data pins, a ground pin and an identification pin, and the power pin, the data pins and the ground pin of the first standard USB plug are electrically connected to the power pin, the data pins and the ground pin of the first mini USB plug, respectively.

15. The USB connector structure as claimed in claim 14, wherein the second standard plug comprises a power pin, a pair of data pins and a ground pin, the second mini USB plug comprises a power pin, a pair of data pins, a ground pin and an identification pin, and the power pin, the data pins and the ground pin of the second standard USB plug are electrically connected to the power pin, the data pins and the ground pin of the second mini USB plug, respectively.

16. The USB connector structure as claimed in claim 15, wherein the power pins are electrically connected to the power line of the cable, the data pins are electrically connected to the first data line, the data pins are electrically connected to the second data line, the group pins are electrically connected to the group line, and the identification pins are floating or are electrically connected to the ground line.

17. The USB connector structure as claimed in claim 10, wherein the first plug group further comprises a first housing, the second plug group further comprises a second housing, and the first standard USB plug and the first mini USB plug are at least partially received within the first housing, the second standard USB plug and the second mini USB plug are at least partially received within the second housing.

18. The USB connector structure as claimed in claim 17, wherein one of the switch modules is electrically connected between the first standard USB plug and the first mini USB plug, and the other switch module is electrically connected between the second standard USB plug and the second mini USB plug.

19. The USB connector structure as claimed in claim 17, wherein the switch modules are exposed from the first housing and the second housing, and each switch module comprises four switches, and the switches are electrically connected to the power line, the two data lines, and the ground line, respectively.

* * * * *